US007594526B2

(12) United States Patent
Freidlund

(10) Patent No.: US 7,594,526 B2
(45) Date of Patent: Sep. 29, 2009

(54) TABLE SAW JIG FOR CUTTING BOX JOINTS

(76) Inventor: Paul J. Freidlund, 6183 161st St. West, Rosemount, MN (US) 55068

( * ) Notice: Subject to any disclaimer, the term of this patent is extended or adjusted under 35 U.S.C. 154(b) by 0 days.

(21) Appl. No.: 12/053,848

(22) Filed: Mar. 24, 2008

(65) Prior Publication Data

US 2008/0216919 A1 Sep. 11, 2008

Related U.S. Application Data

(62) Division of application No. 11/039,031, filed on Jan. 19, 2005, now Pat. No. 7,347,233.

(51) Int. Cl.
*B27M 3/00* (2006.01)

(52) U.S. Cl. ..... 144/360; 144/371; 144/372

(58) Field of Classification Search ..... 144/144.1, 144/144.51, 144.52, 204, 204.2, 253.1, 253.5, 144/253.6, 359, 360, 371, 372; 83/435.11, 83/477.2; 269/69, 111, 287; 409/125, 130, 409/178, 180, 182
See application file for complete search history.

(56) References Cited

U.S. PATENT DOCUMENTS

| | | | |
|---|---|---|---|
| 2,581,049 | A | 1/1952 | Schempers |
| 2,777,485 | A | 1/1957 | Farrow |
| 2,895,513 | A | 7/1959 | Cowley |
| 2,916,063 | A | 12/1959 | Boekenkamp |
| 2,972,366 | A | 2/1961 | Caruso |
| 4,373,562 | A | 2/1983 | Vernon |
| 4,428,408 | A | 1/1984 | Grisley |
| 4,599,927 | A | 7/1986 | Eccardt et al. |
| 4,655,445 | A | 4/1987 | Morse |
| 4,809,755 | A | 3/1989 | Pontikas |
| 5,203,389 | A | 4/1993 | Goodwin |
| 5,318,082 | A | 6/1994 | Von Hollen |
| 5,598,878 | A | 2/1997 | Wirth et al. |
| 5,711,356 | A | 1/1998 | Grisley |
| 5,832,977 | A | 11/1998 | Hampton |
| 6,041,837 | A | 3/2000 | Hanson |

(Continued)

FOREIGN PATENT DOCUMENTS

| | | |
|---|---|---|
| CA | 2275846 | 12/2000 |

*Primary Examiner*—Shelley Self
(74) *Attorney, Agent, or Firm*—Sand & Sebolt

(57) ABSTRACT

A jig for cutting box joints on a table saw, including guide bar clamps adapted to be joined to guide bars of a table saw; a spacer joined to the guide bar clamps; a spacer strip joined to the spacer, the spacer strip defining spacer apertures; a board clamp joined to an engagement pin, the engagement pin engaging one of the spacer apertures of the spacer strip; and mechanism for offsetting pairs of boards such that grooves and projections on a pair of boards is cuttable offset from a corresponding pair and method of use including joining a jig to a table saw; clamping at least two pairs of boards to the jig; positioning the clamped boards relative to the table saw; cutting a groove through all boards; repositioning the clamped boards relative to the table saw; cutting another groove spaced apart from the first groove; repeating the steps of repositioning and cutting another groove until grooves have been cut from one edge to an opposing edge with projections disposed between the grooves; and interlacing the projections and grooves of the pairs of boards to form a box joint.

18 Claims, 18 Drawing Sheets

U.S. PATENT DOCUMENTS 6,076,575 A 6/2000 Harkness
6,095,024 A 8/2000 Brutscher et al.
6,206,060 B1 3/2001 Blake
6,499,224 B1 12/2002 Asick
6,520,225 B1 2/2003 Dembicks
6,588,468 B1 7/2003 Tucker et al.
7,082,974 B1 * 8/2006 Vice ..... 144/371
7,347,233 B2 * 3/2008 Freidlund ..... 144/144.1
7,360,567 B2 * 4/2008 Gregoire ..... 144/253.1

* cited by examiner

TABLE SAW JIG FOR CUTTING BOX JOINTS

CROSS REFERENCE TO RELATED APPLICATION

This application is a divisional application of U.S. patent application Ser. No. 11/039,031, filed Jan. 19, 2005, now U.S. Pat. No. 7,347,233; the disclosure of which is incorporated herein by reference.

The present invention claims priority from U.S. patent application Ser. No. 10/662,192, filed Sep. 15, 2003, now abandoned, entitled JIG FOR FORMING A BOX JOINT.

BACKGROUND OF THE INVENTION

The present invention relates to jigs for cuffing wood and related products and more specifically to jigs used to form box joints with a table saw.

Jigs have long been used to make repetitive cutting simpler. In a typical jig, boards or other material to be cut are uniformly laid on a jig and marked or cut at a specific location. For instance studs to be cut to a certain length may all be abutted along a straight edge. A marker of some form may be positioned at the distance away from the straight edge at which the cut is to be made. Without measuring any of the boards, the woodworker knows where to make the cut across all the boards, e.g., at the point of the marker. Jigs in essence remove the need for repeated measuring.

Various complex joints have been proposed and used for joining adjacent corners of furniture. The dove tail, box joint and many other varieties of joints have been developed in this regard. Each type of joint has certain benefits and detriments associated with the joint. Typically, these joints all suffer from complexity of cutting.

Some jigs have been proposed for cutting the box joint. These jigs generally allow only two of the four boards to be cut at the same time. Thus, the woodworker needs to adjust the jig for the first pair of boards, turn the boards over and continue cutting. Then the jig is readjusted and the process of cutting turning and cutting is repeated. If the jig is not set up correctly between the pairs of boards, wood is wasted and the process is continued until the cuts are at the right location. Moreover, these jigs typically have a maximum size of board that can be used with the jig further adding to their limitations.

What is needed is a jig that allows all four boards to be cut simultaneously. The jig should be simple to arrange, preferably mechanical, have manner of aligning the boards which does not require adjustment and be suitable to use with boards of any conceivable length.

SUMMARY OF THE INVENTION

The present invention is a jig that allows all four boards to be cut simultaneously. The jig is simple to arrange, mechanical, has manner of aligning the boards which does not require adjustment and is suitable to use with boards of any conceivable length.

The present jig for cutting box joints on a table saw may be provided with guide bar clamps adapted to be joined to guide bars of a table saw. A spacer may be joined to the guide bar clamps. A spacer strip may be joined to the spacer. The spacer strip defines spacer apertures, having a gap therebetween. The gaps preferably are equidistant in length. A board clamp can join to an engagement pin with the engagement pin engaging one of the spacer apertures of the spacer strip. Desirably, mechanism is provided for offsetting pairs of boards such that grooves and projections on a pair of boards is cuttable offset from a corresponding pair.

The present jig is also provided with a method of cutting boards for a box joint, including joining a jig to a table saw; clamping at least two pairs of boards to the jig; positioning the clamped boards relative to the table saw; cutting a groove through all boards; repositioning the clamped boards relative to the table saw; cutting another groove spaced apart from the first groove; repeating the steps of repositioning and cutting another groove until grooves have been cut from one edge to an opposing edge with projections disposed between the grooves; and interlacing the projections and grooves of the pairs of boards to form a box joint.

Advantageously, the present invention allows cutting of all four boards on a table saw to form box joints between the boards.

Also advantageously, the present invention provides for alignment of the boards such that the saw blades of a table saw may be moved in a straight line from one board to the next and cut all four boards at the correct location.

As yet a further advantage, the present invention provides a mechanism for properly aligning the boards for cutting with the boards being of unlimited length.

As still another advantage, the present invention is usable with any table saw, avoiding the need for additional power tools.

These and other advantages will be made clear from the detailed description below.

DETAILED DESCRIPTION OF THE INVENTION

Figure 1:
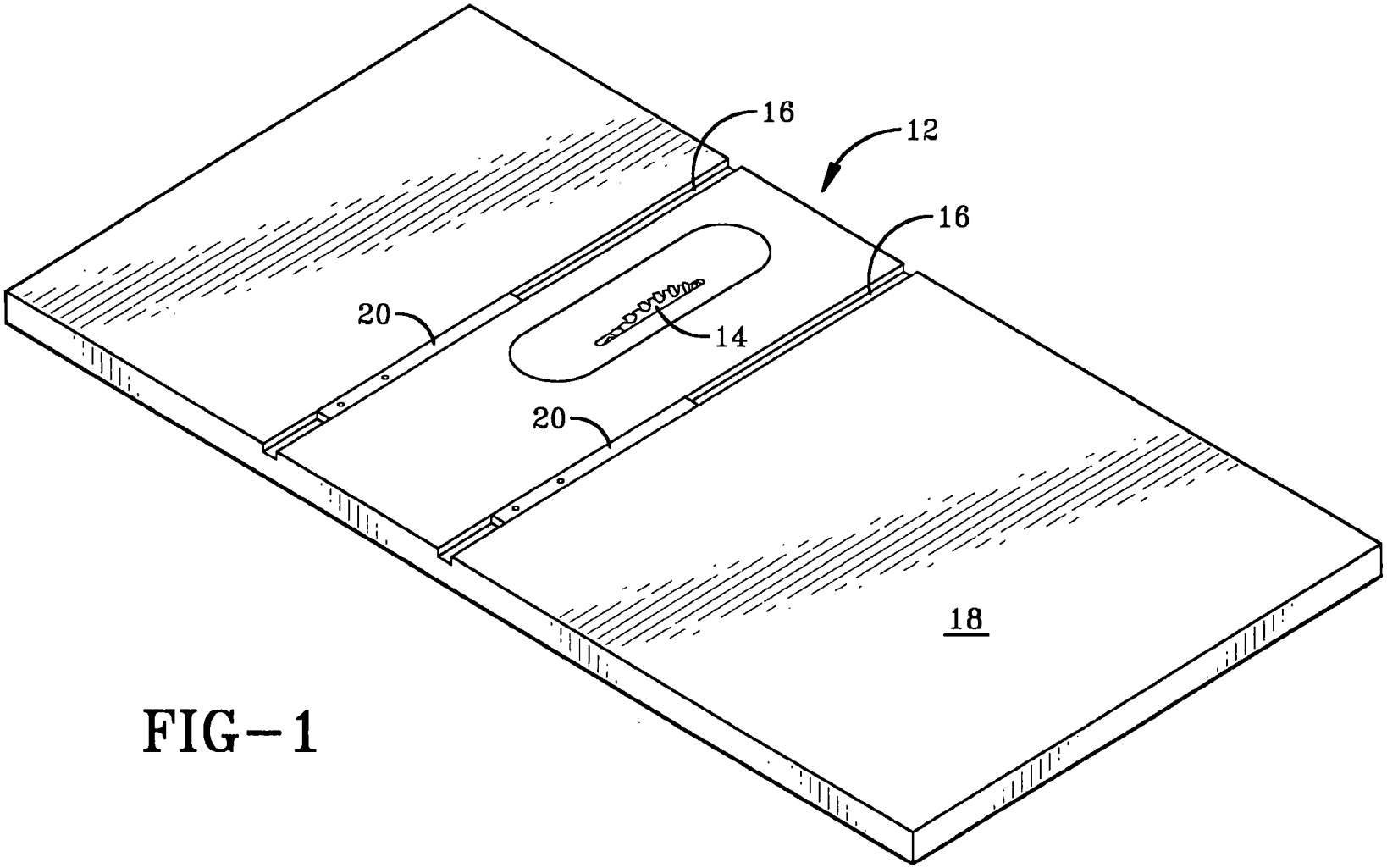
FIG. 1 is a perspective view of the upper surface of a table saw, showing the blade and guide bars.

The jig 10 for cutting box joints on a table saw 12 may include a table saw 12, guide bar clamps 30, a spacer 50, a blade guard 80, a spacer strip 90, a zero tolerance insert 100, a board clamp 110, and boards 140. These components interact, as described below to cut box joints on a table saw, while cutting all four boards at the same time. Each component will be discussed in serial fashion below.

Referring to FIG. 1, the table saw 12 desirably has cutting blades 14, a pair of guide grooves 16 defined in the upper surface 18 of the table saw 12. The cutting blade 14 may determine the width of grooves 144 in the boards 140. The guide grooves 16 are disposed on either side of the cutting blades 14, cooperatively engaging a pair of guide bars 20. Each guide bar 20 slidably moves within one of the guide grooves 16, carrying material toward and away from the cutting blades 14 in a direction parallel to the cutting blades 14. The jig 10 is joined to the table saw 12.

Figure 2:
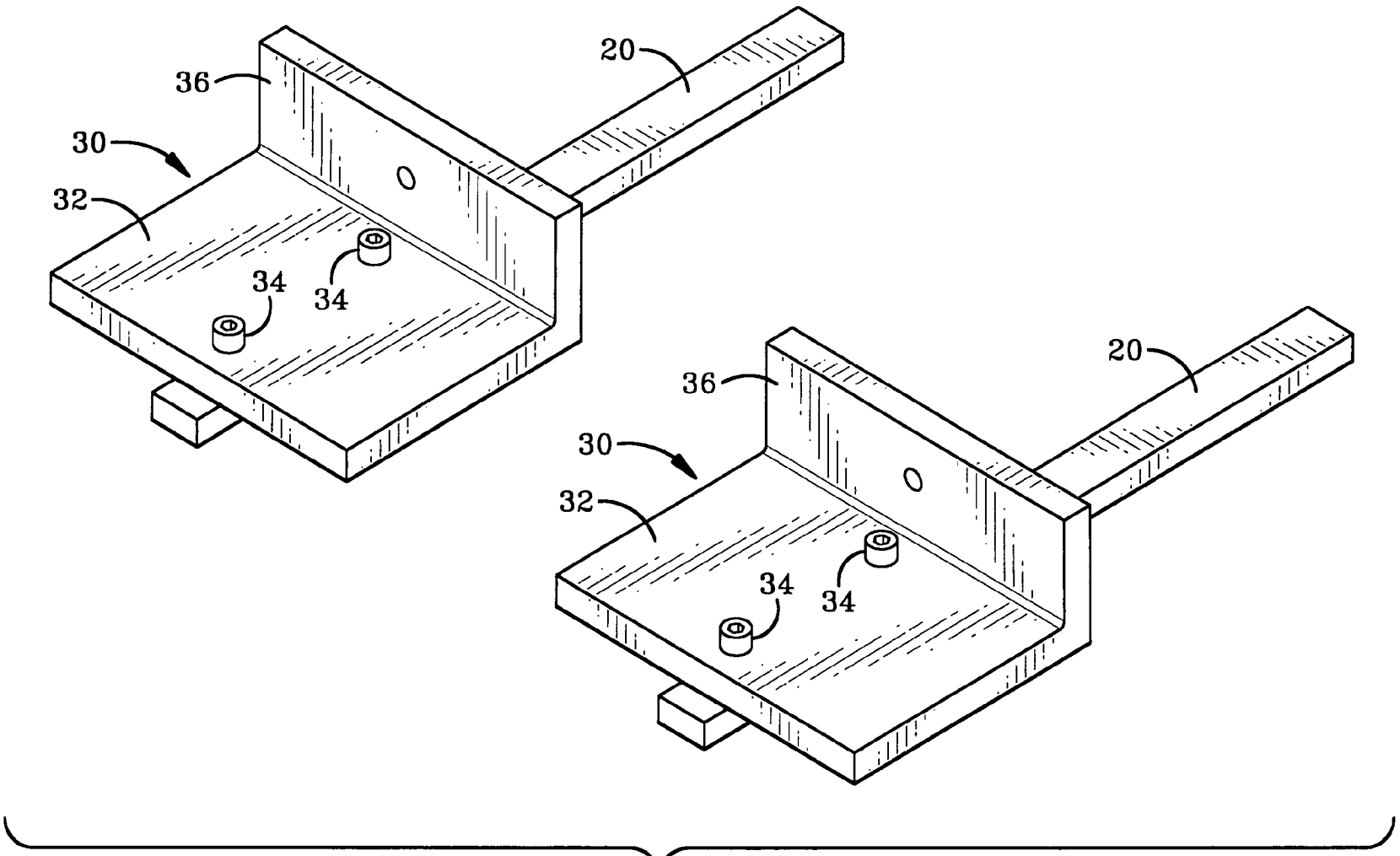
FIG. 2 is a perspective view of the guide bar clamps joined to the guide bars.

Guide bar clamps 30, FIG. 2, may be of any design, shape or configuration that is suitable for joining the spacer 50 to the guide bars 20. Herein, the preferred design for guide bar clamps 30 is shown as a piece of angled iron. Fasteners 34 may join the guide bar clamps 30 to the guide bars 20 and fasteners 38 may join the guide bar clamp 30 to the spacer 50. Alternatively, guide bar clamps 30 each with a guide bar segment 32 may be contiguously formed with a spacer segment 36.

Figure 3:
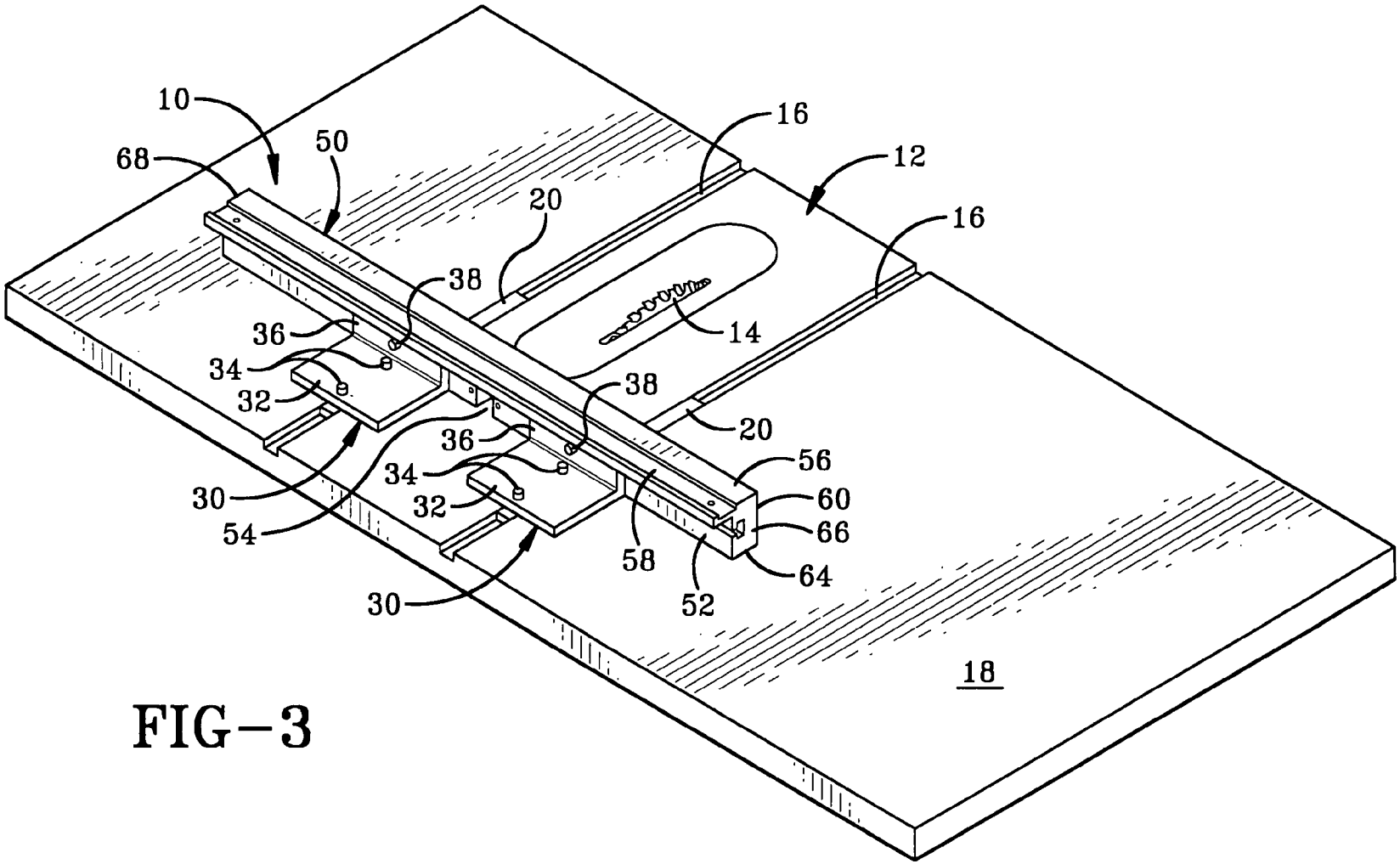
FIG. 3 is a perspective view of the table saw with the spacer joined to the guide bar clamps.

The spacer 50 (FIG. 3), which may be contiguously joined to the guide bar clamps 30, has a front surface 52 connected to both of the guide bar clamps 30. The front surface 52 may define a notch 54, sized and adapted to allow the cutting blades 14 to pass therethrough. A top surface 56 of the spacer 50 may define a groove 58 sized and adapted to receive the spacer strip 90 therein. The back surface 60 may define a sink 62 disposed about the notch 54, such notch 54 extending from the front surface 52 through the spacer 50 to the back surface 60. The sink 62 is sized and adapted to receive a zero tolerance insert 100 therein. The spacer 50 may further have a bottom surface 64, a right end 66 and a left end 68.

Figure 4:
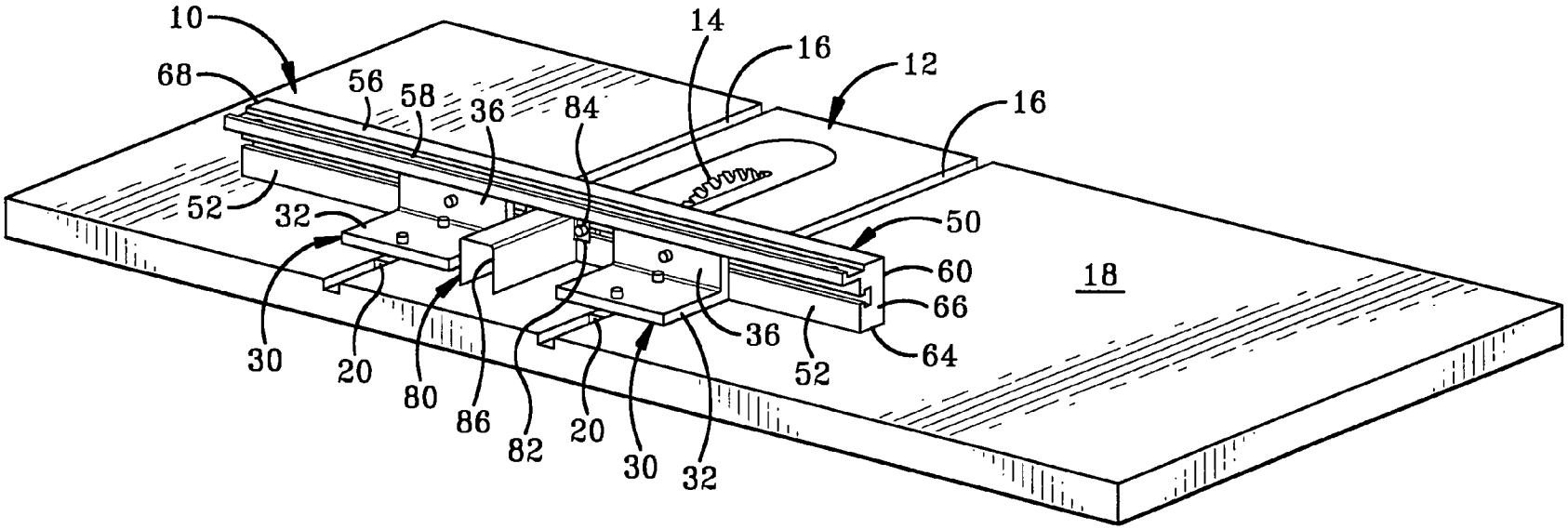
FIG. 4 is a perspective view showing the blade guard joined to the spacer.
Figure 5:
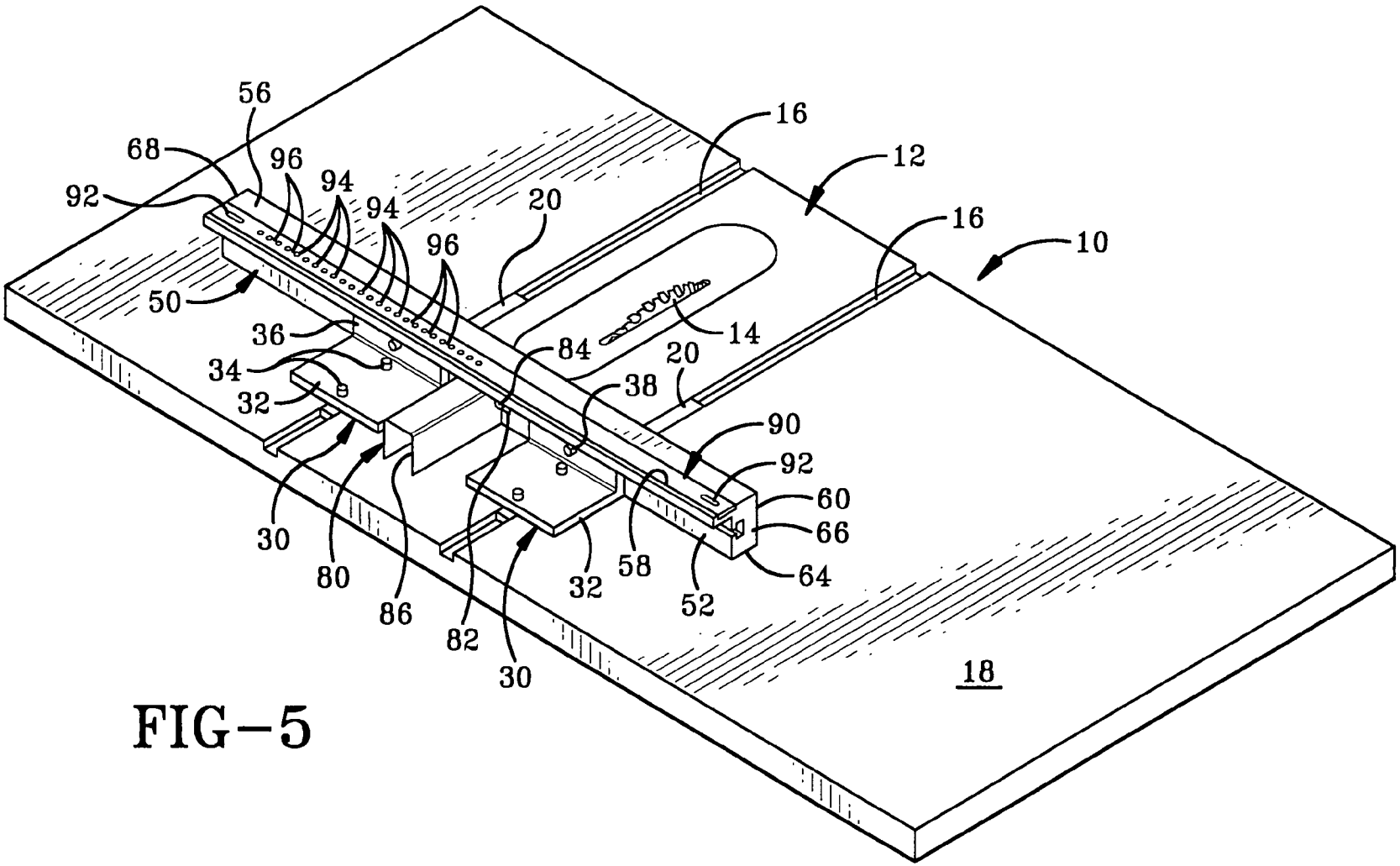
FIG. 5 is a perspective view showing the spacer strip joined to the spacer.
Figure 6:
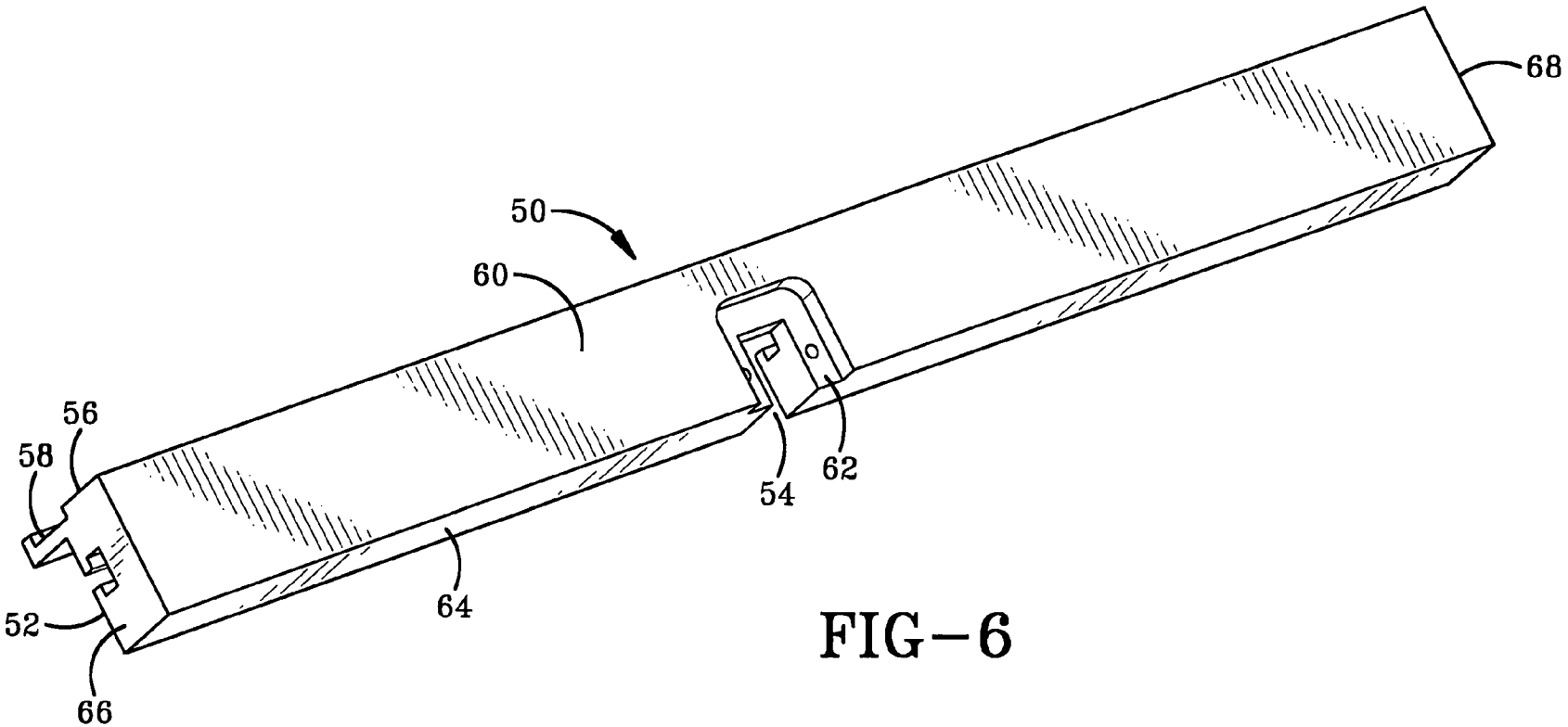
FIG. 6 is a perspective view of the back surface of the spacer, showing the sink.

The blade guard 80, FIG. 4, may be any suitable guard to protect the user's hands from the cutting blades 14. The blade guard 80 may have ears 82 and define a channel 86. The channel 86 extends coaxially with the notch 54, shielding the cutting blades 14 after the cutting blades 14 pass through the notch 54. The ears 82 provide a surface for fasteners 84 to secure the blade guard 80 to the spacer 50.

The spacer strip 90, which may be contiguously joined to the spacer 50 or replaceable with a variety of other spacer strips 90, may define fastener apertures 92 and spacer apertures 94. The fastener apertures 92 allow for selective attachment of the spacer strip 90 to the spacer 50 within the groove 58. In this manner a variety of spacer strips 90 may be used with the present jig 10. The spacer apertures 94 cooperate with the board clamp 110 to perpendicularly position the board clamp 110 relative to the cutting blades 14.

The distance between the spacer apertures 94, herein referred to as the gap 96, determines the amount of distance the board clamp 110 is perpendicularly repositionable relative to the cutting blades 14. The gaps 96 of a particular spacer strip 90 are equidistant in length. Thus, the spacer strip 90 is selected such that the gap 96 is of a dimension corresponding to the width of the cut formed by the cutting blades 14. The gap 96 and cutting blade 14 determine the width of a projection 146 of the boards 140, while the cutting blades 14 determine the width of the grooves 144. The spacer strip 90 is selected such that the grooves 144 and projections 146 are of the same width. A plurality of interchangeable spacer strips 90 may have different gap 96 lengths to vary the width of the projections 146 and grooves 144 at the behest of the user.

Figure 16:
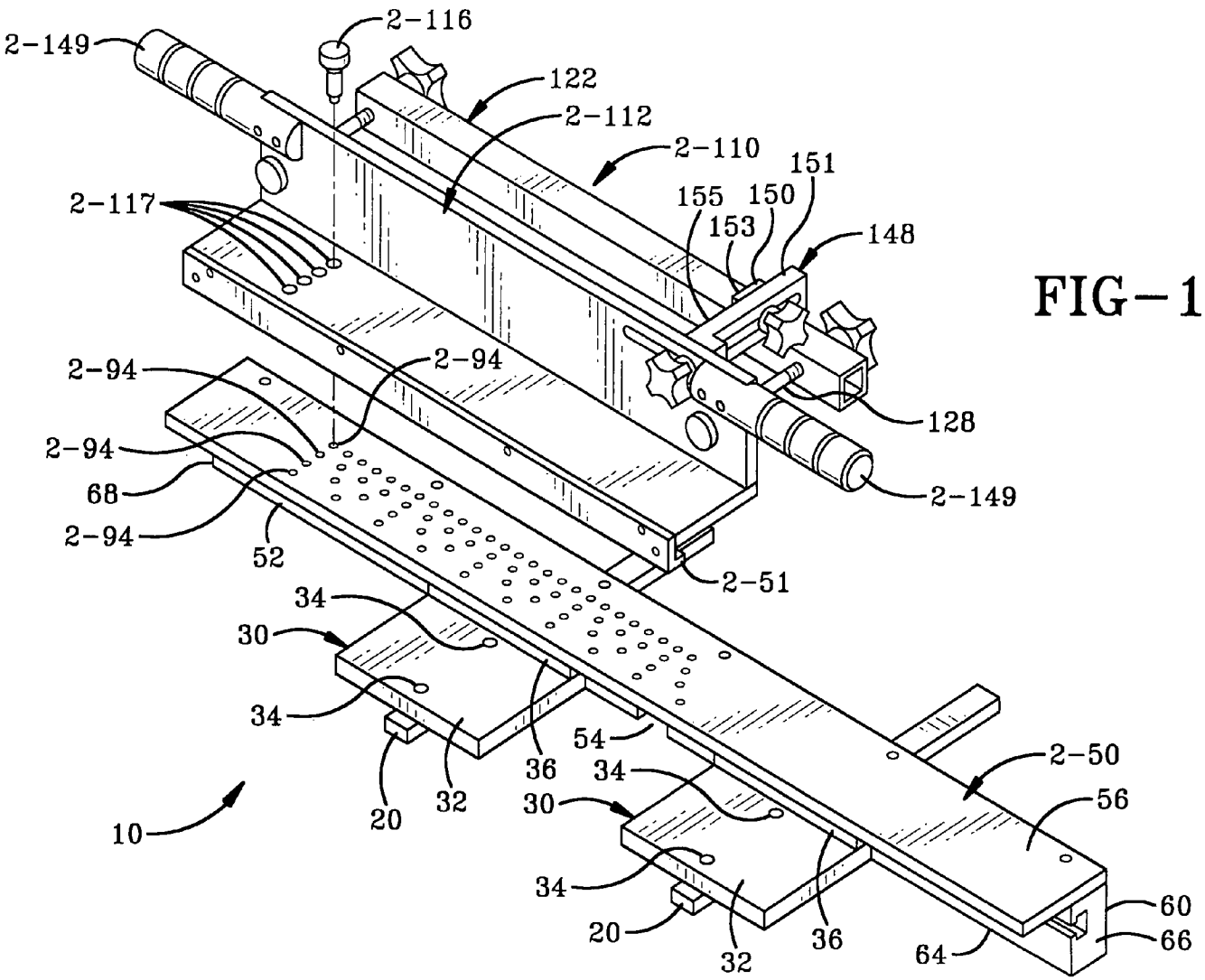
FIG. 16 is a perspective view partially exploded showing an alternate embodiment of the present invention.
Figure 17:
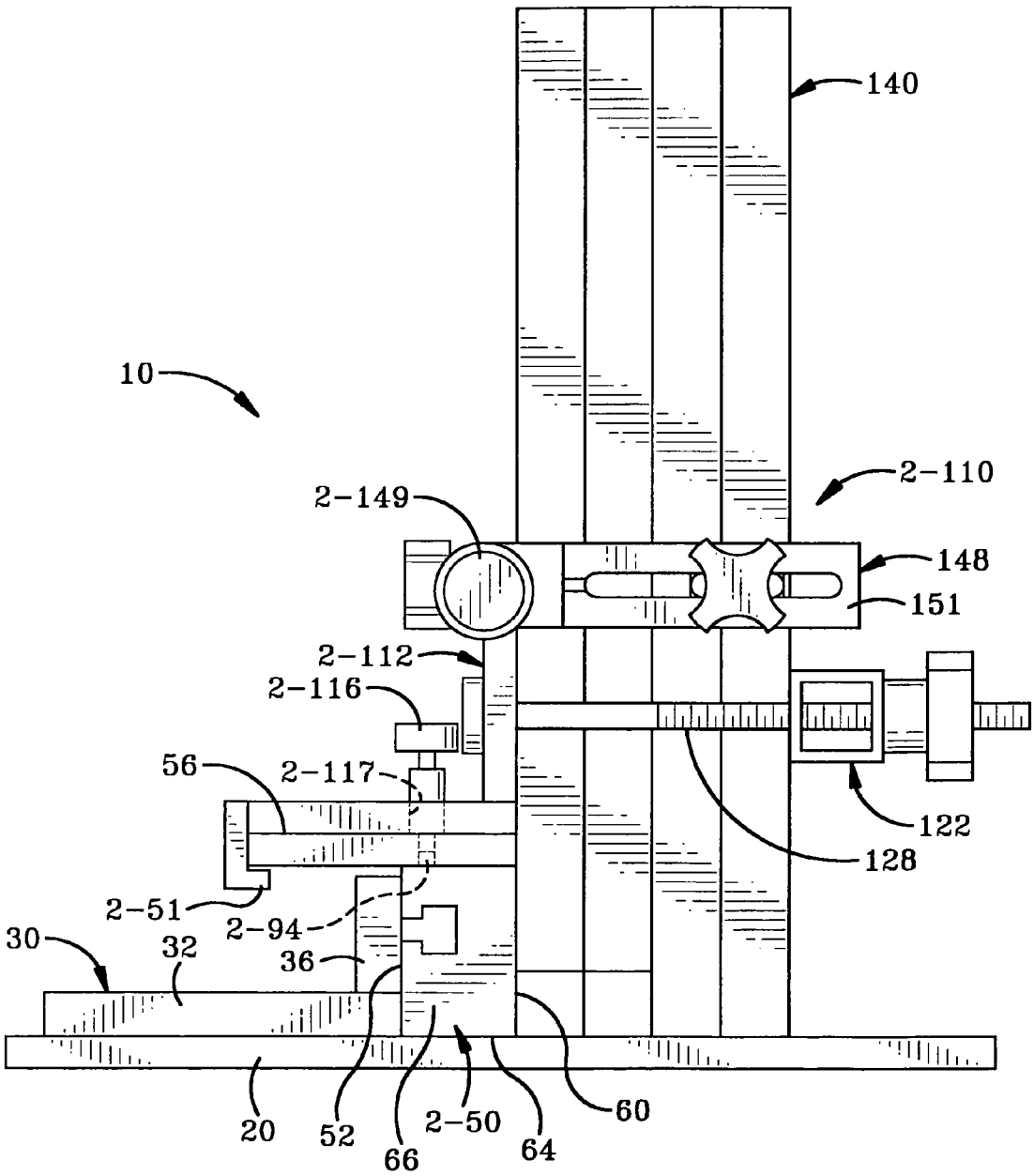
FIG. 17 is an end view showing of the alternate embodiment.
Figure 18:
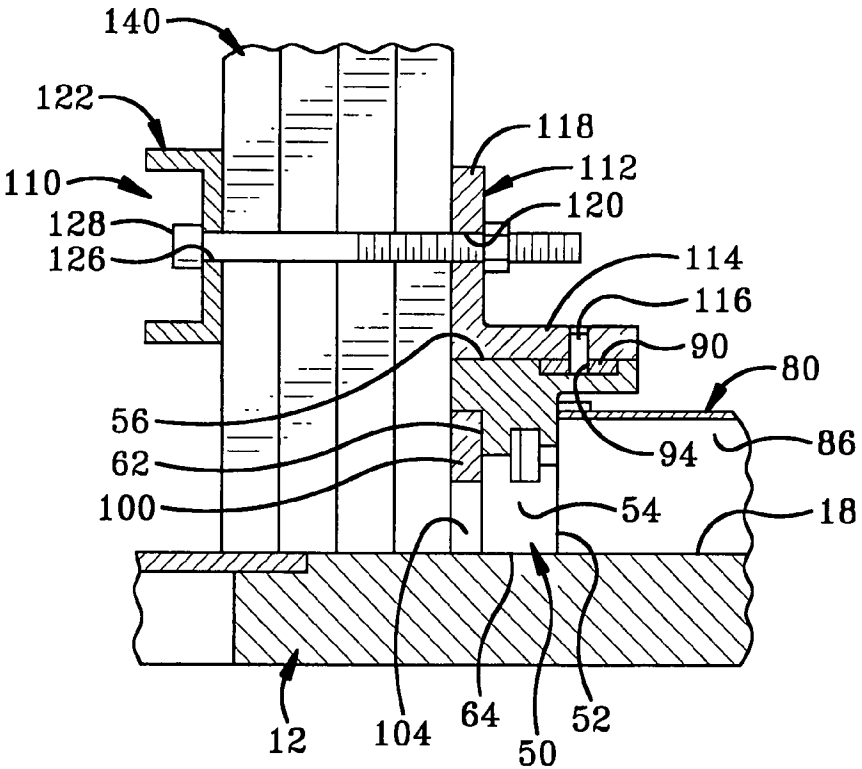
FIG. 18 is a side view showing the jig with boards secured thereto.

Alternatively, the spacer apertures 94 may defined in a plurality of rows through the top surface 56 of the spacer 50 as shown in FIG. 16. With reference to FIG. 16, part numbers use a leading "2-" to assist in coordinating other parts of the discussion to that shown in FIG. 16. For instance spacer apertures 94 are denoted 2-94 in FIG. 16. The engagement pin 2-116 may have a plurality of ports 2-117 that each correspond to a row of spacer apertures 2-94. That is, placing the engagement pin 2-116 into a particular port selects the row of spacer apertures 2-94 that the engagement pin 2-116 may interact. In the preferred mode, the engagement pin 2-116 the port 2-117, and the spacer apertures 2-94 have engageable threading, as a nut and bolt, and the front portion 2-112 of the board clamp 2-110 has a lip 2-51 that hooks around the spacer 2-50 and preferably has a pair of handles 2-149 on board clamp 110. Handles 2-149 assist in moving jig 10 along table saw 12 towards and away from saw blades 14 by manually exerting a force on handles 2-149. Such an arrangement selectively secures the front portion 2-112 to the spacer 2-50 as shown in FIG. 17. In use the engagement pin 2-116 engages the first spacer aperture 2-94 and the first groove 144 is cut. Then the board clamp 110 is moved so that the engagement pin 2-116 indexes to the next spacer aperture 2-94 where the next groove 144 and so forth. Further operation is described shortly below with regard to the board clamp 110.

Figure 7:
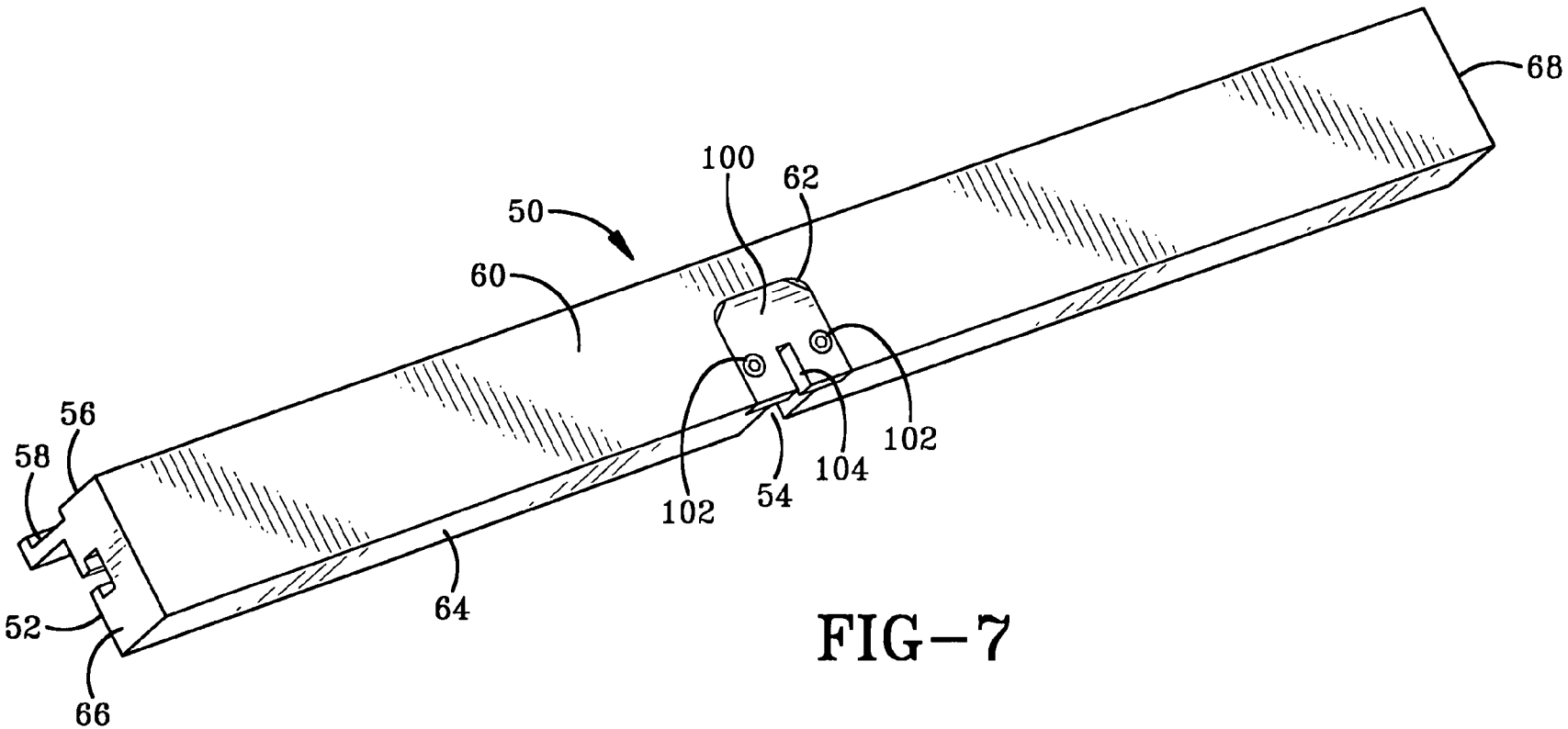
FIG. 7 is a perspective view of the zero tolerance insert joined to the spacer.

The zero tolerance insert 100 (FIG. 7) may have fasteners 102 and a blade slot 104. The zero tolerance insert 100 places pressure on the boards 140 adjacent the cutting blades 14 to prevent splintering of the boards 140 during cutting. The zero tolerance insert 100 preferably is received within the sink 62 and fasteners 102 join the insert 100 to the spacer 50 such that the exposed surfaces of the spacer 50 and insert 100 are co-extensive. The blade slot 104 is sized and adapted to closely receive the blades 14 therethrough.

Figure 8:
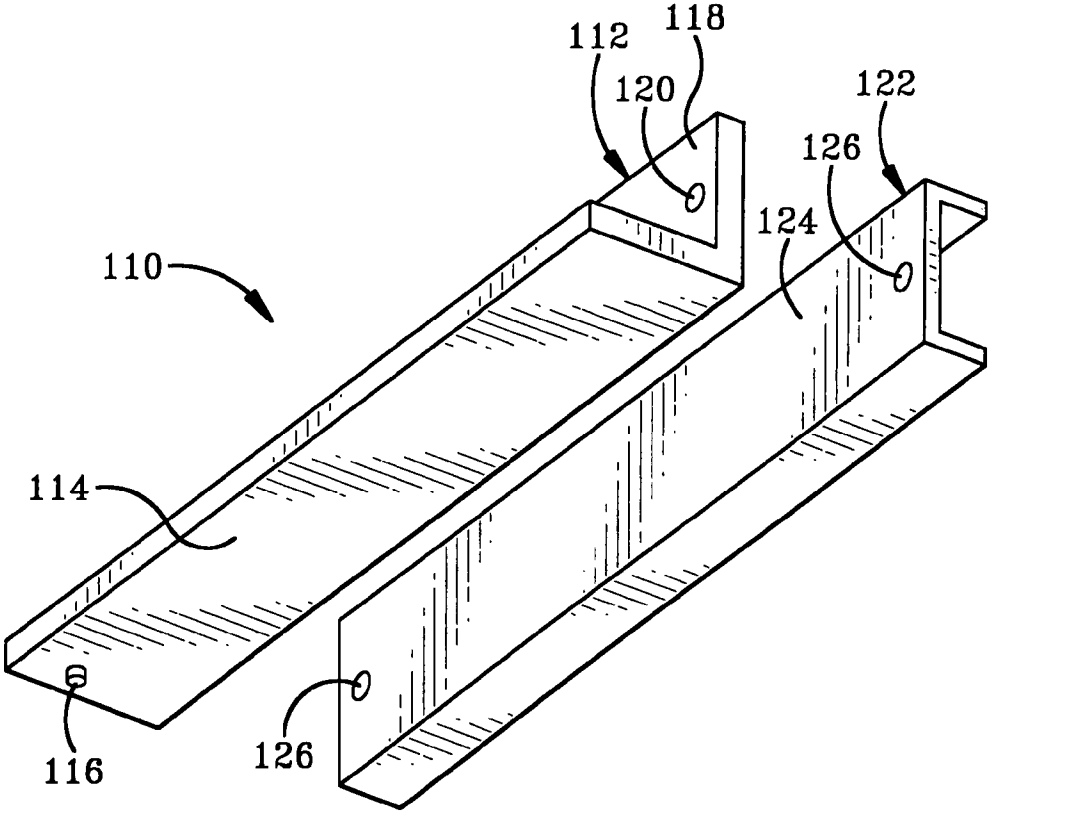
FIG. 8 is a perspective view, showing a portion of the board clamp and engagement pin.
Figure 9:
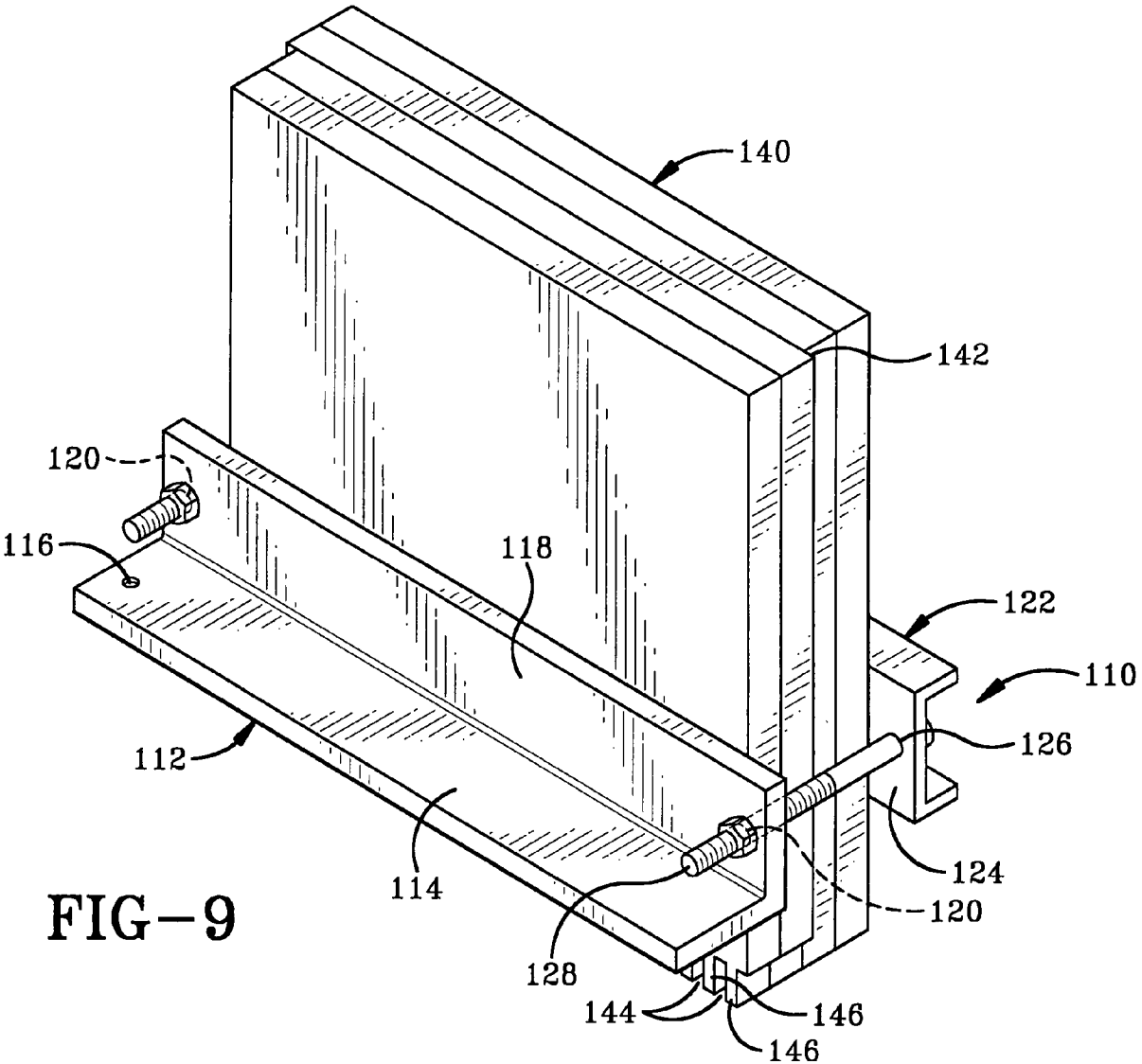
FIG. 9 is a perspective view showing the board clamp fastened to the boards.

The board clamp 110 (FIGS. 8-10) may come in a variety of sizes, shapes and designs, but generally should interact with the spacer strip 90, such that it may be moved a predetermined distance perpendicularly to the cutting blades 14. A suitable board clamp 110 has a front portion 112, a back portion 122 and clamps fasteners 128. The preferred front portion 112 has a spacer segment 114 contiguously connected to a board segment 118 with the spacer segment contiguously joined to at least one engagement pin 116. The engagement pin 116 is positioned and adapted to engage the spacer apertures 94 of the spacer strip 90. The board clamp 110 may then be manually moved to engage the engagement pin 116 with consecutive spacer apertures 94 as the grooves 144 are cut. The board segment 118 of the front portion 112 may define apertures 120. The back portion 122 may have a board segment 124 defining apertures 126. Clamp fasteners 128 extend through the apertures 120, 126 of the board segments 118, 124 of the front and back portions 112, 122 respectively. The fasteners 128 may be tightened to firmly grip the boards 140 and loosened to release the boards 140.

At least one pair of boards 140, preferably two or more pairs, may be disposed within the board clamp 110. The board 140 is positioned to cut grooves 144 and projections 146 in at least one end thereof. The grooves 144 are sized to snugly receive the projections 146 of another board 140 therein. A pair of boards 140, as used herein, is intended to be the boards 140 that will form opposing sides of a box. Two pairs of boards 140 may be cut at the same time such that one pair of boards 140 form sides adjacent to the sides formed by the other pair of boards 140. Thus, all four sides of a box may be cut at the same time.

The pairs of boards 140 need to be offset a distance 142 such that a groove 144 on one board 140 lines up with a projection 146 on another board. (FIGS. 9-15 and 16). The offset 142 is equivalent to the width of a groove 144 or projection 146 (which are the same width). That is, the offset lines up all grooves 144 and all projections 146 on both pairs of boards 140. Accordingly, the jig 10 is provided with an offset mechanism 148 as shown in FIG. 16 for offsetting a pair or pairs of boards 140 such that the grooves 144 and projections 146 on one or a pair of boards is cuttable offset from a corresponding one or pair of boards 140. The mechanism 148 includes an alignment bar 151 which may be adjustably joined to the front portion 112 of the board clamp 110 and which includes an adjustable plate 150 having a pair of offset faces 153 and 155 offset from each other the thickness of the offset 142 as shown particularly in FIG. 16. Interchangeable adjustment plates 150 may be used to accommodate different sized offsets 142.

Figure 10:
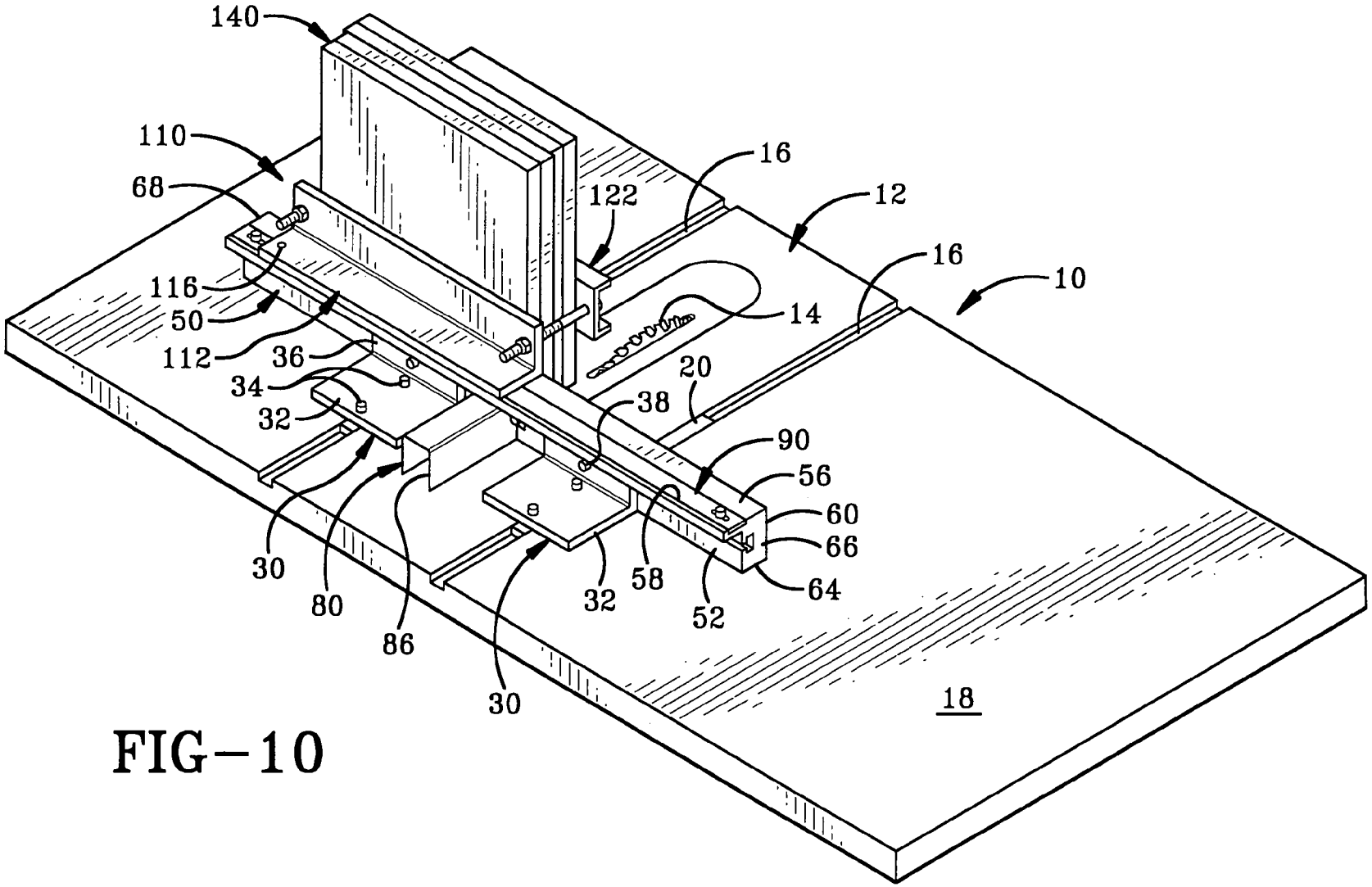
FIG. 10 is a front perspective view of the jig joined to a table saw and boards.
Figure 11:
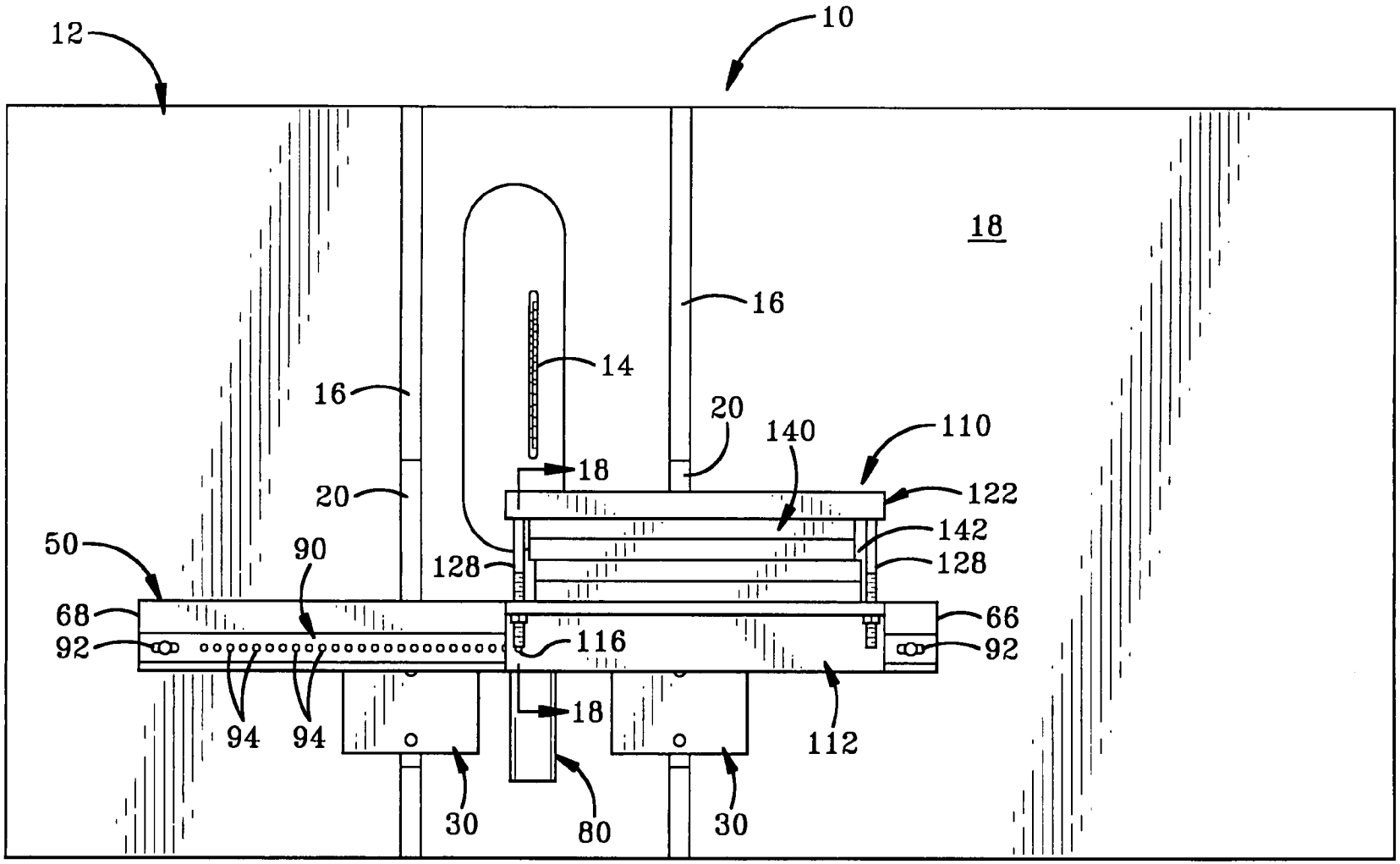
FIG. 11 is a top view of the jig joined to a table saw and boards.
Figure 12:
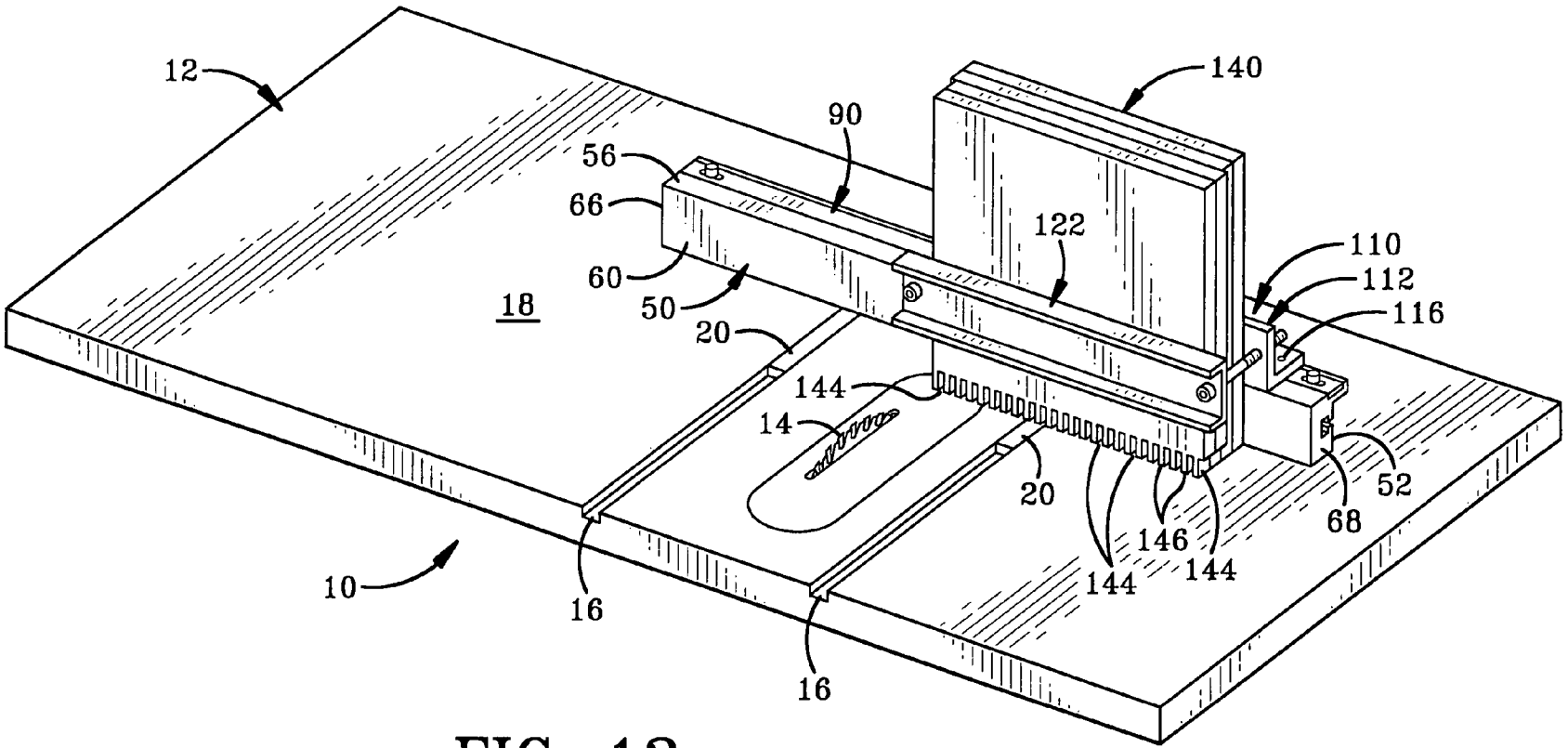
FIG. 12 is a back perspective view, showing the jig joined to a table saw and boards.
Figure 13:
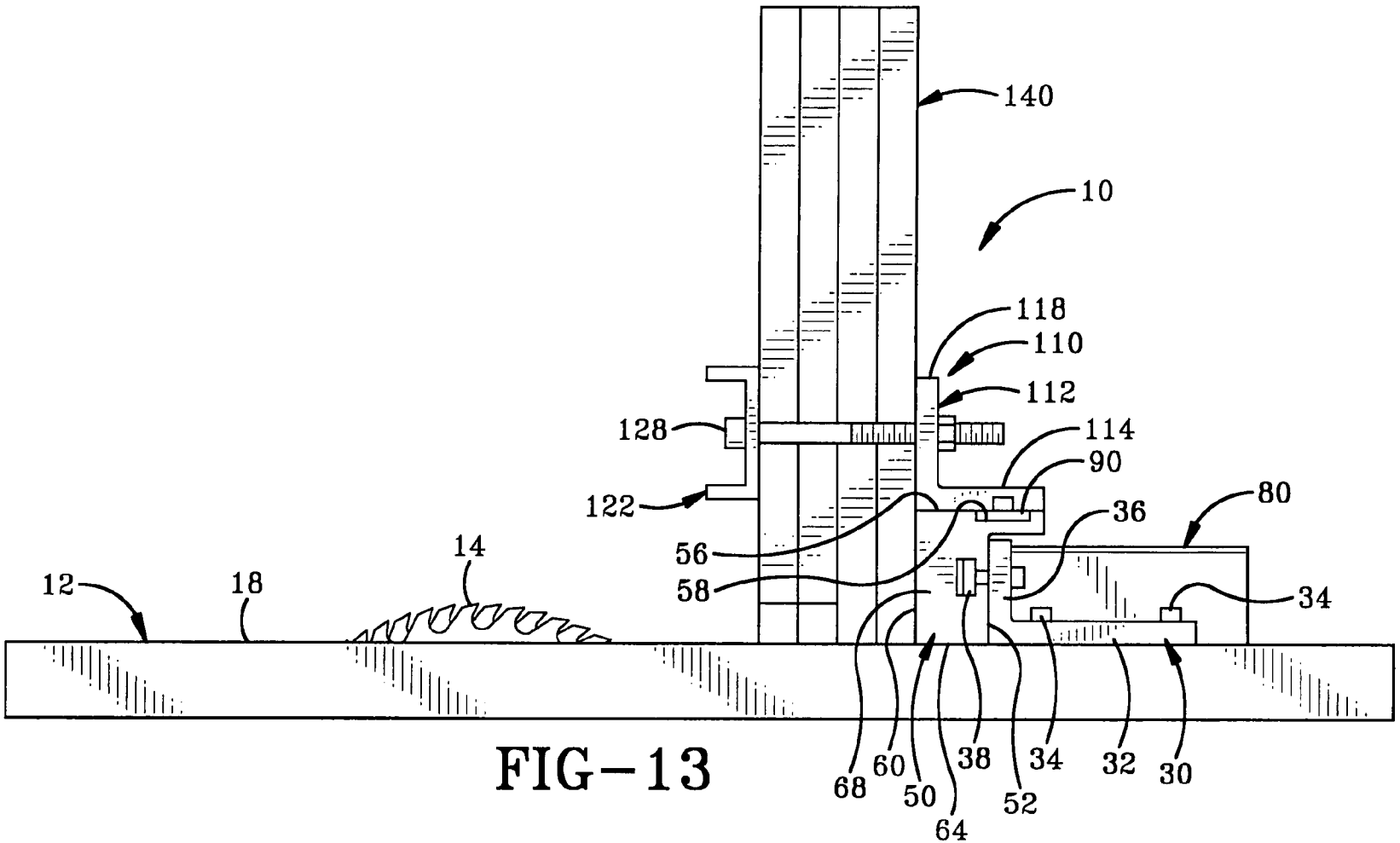
FIG. 13 is a left side view, showing the jig joined to a table saw and boards.
Figure 14:
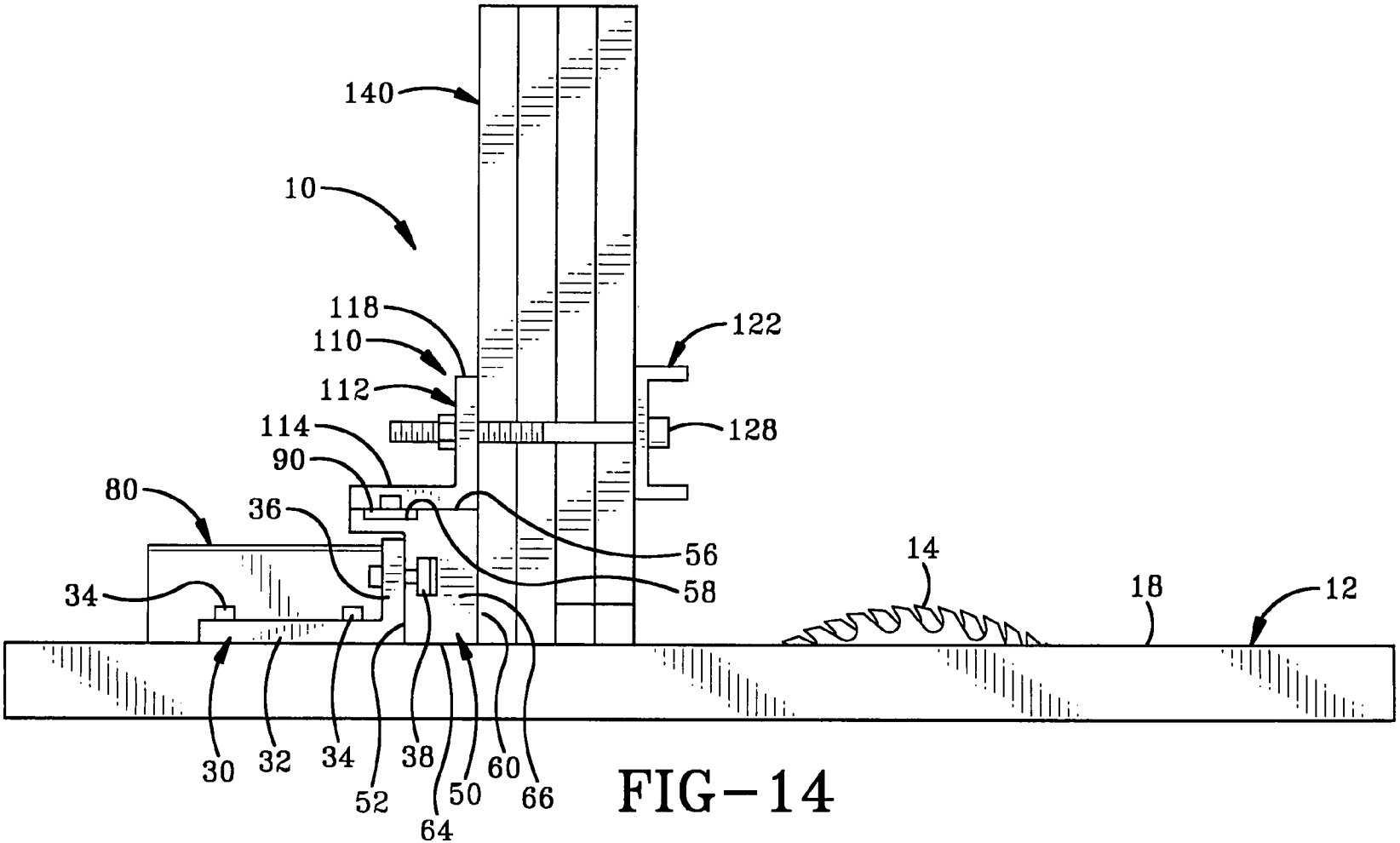
FIG. 14 is a right side view, showing the jig joined to a table saw and boards.
Figure 15:
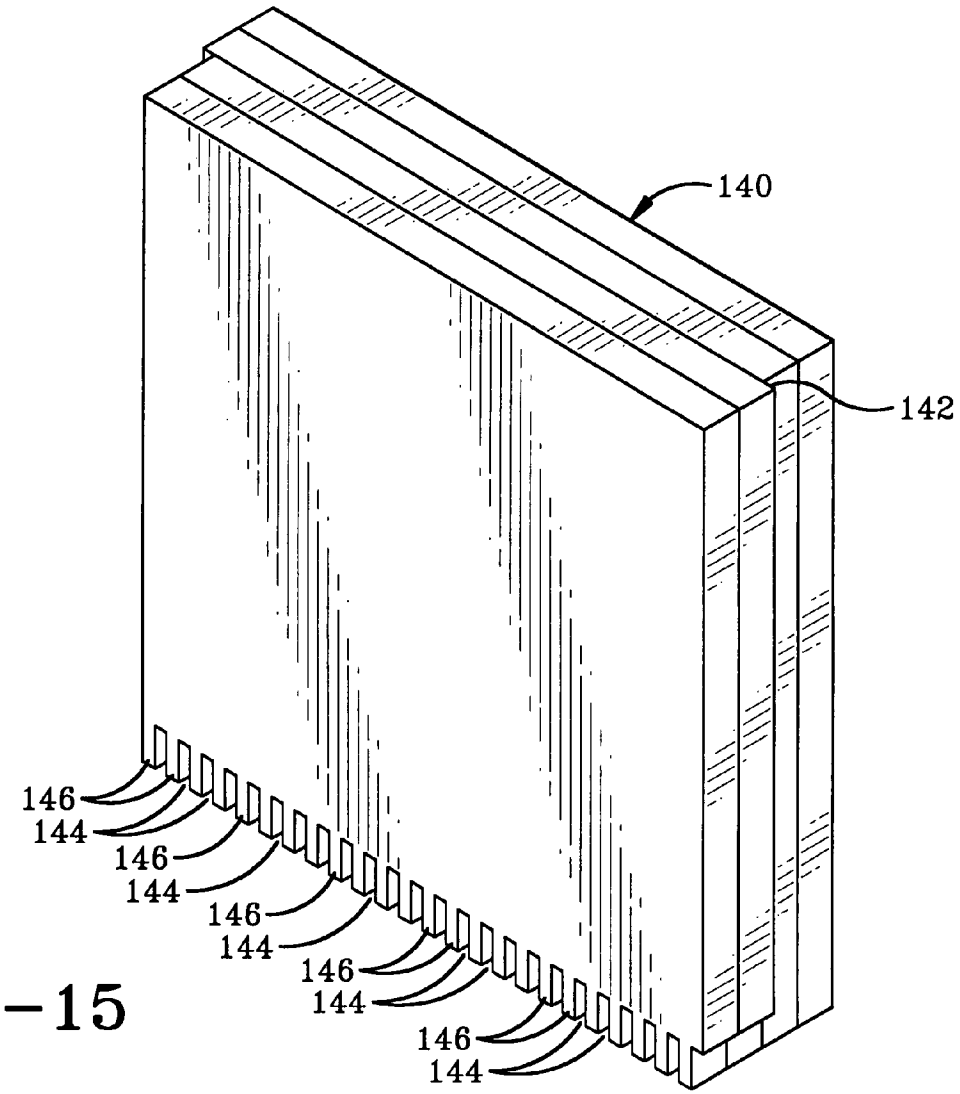
FIG. 15 is a perspective view, showing the boards with the grooves and projections cut in one end thereof.

Alternatively, the cutting blade 14 may be the mechanism for offsetting as demonstrated in FIG. 10. There, a surface of the cutting blade 14 is made coplanar with the edges of one pair of boards 140, while indenting or offsetting a second pair of boards 140. Alternatively, a shim of suitable dimension may be inserted between the clamp fastener 128 and the edges of a pair of boards 140, with the shim being of the width of a projection 146 or groove 144. As yet another alternative, a pair of boards 140 may be offset a distance measured with a tape measure or other device; again the offset being equivalent to the width of a projection 146 or groove 144.

The boards 140 desirably have grooves 144 and projections 146 cut into both ends of the boards. The projections of one pair of boards 140 is sized to be snugly received within the grooves 144 of the second pair of boards 140 in an interlaced manner. Four boards 140 are put together in an interlacing manner to form a box.

The method of cutting boards 140 for a box joint may include the following steps including joining a jig 10 to a table saw 12; clamping at least two pairs of boards 140 to the jig 10; positioning the clamped boards 140 relative to the table saw 12; cutting a groove 144 through all boards 140; repositioning the clamped boards 140 relative to the table saw 12; cutting another groove 144 spaced apart from the first groove 144; repeating the steps of repositioning and cutting another groove 144 until grooves 144 have been cut from one edge to an opposing edge with projections 146 disposed between the grooves 144; and interlacing the projections 146 and grooves 144 of the pairs of boards 140 to form a box joint. Desirably, the step of clamping includes clamping more than two pairs of boards 140 simultaneously. When clamping multiple pairs of boards 140, it is preferable that the pairs of boards 140 are offset the width of a groove 144 before clamping the boards 140.

Although the present invention has been described with reference to preferred embodiments, workers skilled in the art will recognize changes may be made in form and detail without departing from the spirit and scope of the invention.

The invention claimed is:

1. A method of cutting boards for a box joint on a table saw having a saw blade, comprising the steps of:

mounting a jig on the table saw, wherein said jig has an elongated spacer mounted on and extending between a pair of spaced guide bars moveably mounted in a pair of channels formed in the table saw;

clamping at least two boards in an offset relationship in a board clamp slidably moveably mounted on the spacer;

positioning the clamped boards relative to the saw blade of the table saw;

inserting an engagement pin through aligned holes formed in the board clamp and spacer to position the offset boards in a selected fixed position on the spacer;

cutting a first groove through the pair of boards;

repositioning the clamped boards relative to the table saw blade by slidably moving the board clamp along the spacer in a direction transverse to the saw blade; and cutting a second groove spaced apart from the first groove in the pair of clamped boards.

2. The method defined in claim 1 including the step of repeating the steps of repositioning the clamped boards and cutting a plurality of grooves in the clamped boards until grooves have been cut from one edge to an opposing edge of said boards with projections disposed between the grooves.

3. The method defined in claim 2 including the step of interlacing the projections and grooves of the pairs of board to form a box joint.

4. The method of claim 1 wherein the step of clamping the boards includes clamping two pairs of boards in the board clamp in an offset relationship.

5. The method of claim 1 further including the step of offsetting the pairs of boards in an offset mechanism before clamping the boards.

6. The method of claim 1 including the step of providing a plurality of rows of holes in the spacer separated by gaps of equal length in each of the individual rows.

7. The method of claim 6 including the step of providing the gaps of adjacent rows in the spacer with different lengths.

8. The method of claim 7 including the step of providing a plurality of apertures in the board clamp, each aperture being in selective alignment with one of the rows of holes in the spacer.

9. The method of claim 1 including the steps of providing a pair of handles on the board clamp; and moving the jig along the table saw towards and away from the saw blade by manually exerting a force on the handles.

10. The method of claim 1 including the step of passing the saw blade through an opening formed in the spacer when cuffing the first and second grooves in the clamped boards.

11. The method of claim 10 including the step of providing a zero tolerance insert in the opening formed in the spacer.

12. The method of claim 1 including the step of determining the width of the first and second grooves by the width of the saw blade.

13. The method of claim 1 including the step of securing the spacer to the guide bars by a plurality of fasteners.

14. A method of cutting boards for a box joint on a table saw having a saw blade, comprising the steps of:

mounting a jig on the table saw, wherein said jig has an elongated spacer mounted on and extending between a pair of spaced guide bars moveably mounted in a pair of channels formed in the table saw in a direction parallel to the saw blade;

clamping at least two boards in an offset relationship in a board clamp slidably moveably mounted on the spacer in a direction transverse to the saw blade;

positioning the clamped boards relative to the saw blade of the table saw;

inserting an engagement pin through aligned holes formed in the board clamp and spacer to position the offset boards in a selected fixed position on the spacer;

cutting a first groove through the pair of boards by moving the spacer and clamped boards in a direction towards and past the saw blade;

repositioning the clamped boards relative to the table saw blade by slidably moving the board clamp along the spacer in a direction transverse to the saw blade;

securing the repositioned board clamp on the spacer; and then cutting a second groove spaced apart from the first groove in the pair of clamped boards by moving the spacer and clamped boards in a direction towards and past the saw blade.

15. The method of claim 14 including the step of providing a plurality of rows of holes in the spacer separated by gaps of equal length in each of the individual rows.

16. The method of claim 15 including the step of providing the gaps of adjacent rows in the spacer with different lengths.

17. A method of cutting boards for a box joint on a table saw having a saw blade, comprising the steps of:

mounting a jig on the table saw, wherein said jig has an elongated spacer mounted on and extending between a pair of spaced guide bars moveably mounted in a pair of channels formed in the table saw;

clamping at least two boards in an offset relationship in a board clamp slidably moveably mounted on the spacer;

providing an offset mechanism on the board clamp for clamping the boards in the offset relationship;

positioning the clamped boards relative to the saw blade of the table saw;

cutting a first groove through the pair of boards;

repositioning the clamped boards relative to the table saw blade by slidably moving the board clamp along the spacer in a direction transverse to the saw blade;

maintaining the at least two boards in their offset relationship during the step of repositioning the claimed boards; and cutting a second groove spaced apart from the first groove in the pair of clamped boards relative to the table saw.

18. The method of claim 17 including the step of providing a pair of offset faces on the offset mechanism offset from each other the thickness of the offset of the pair of boards.

* * * * *

UNITED STATES PATENT AND TRADEMARK OFFICE

CERTIFICATE OF CORRECTION

PATENT NO. : 7,594,526 B2
APPLICATION NO. : 12/053848
DATED : September 29, 2009
INVENTOR(S) : Freidlund It is certified that error appears in the above-identified patent and that said Letters Patent is hereby corrected as shown below:

Column 6; line 44 Change "cuffing" to -- cutting --

Signed and Sealed this

Twenty-fourth Day of November, 2009

David J. Kappos

David J. Kappos
*Director of the United States Patent and Trademark Office*